United States Patent [19]

Galbreath et al.

[11] Patent Number: 4,545,523

[45] Date of Patent: Oct. 8, 1985

[54] WASTE MATERIAL HANDLING CONTAINER WITH LIQUID TIGHT DOOR SEAL

[75] Inventors: Donald E. Galbreath; Brooks Roudebush; Robert N. O'Donnell, all of Winamac, Ind.

[73] Assignee: Galbreath Incorporated, Winamac, Ind.

[21] Appl. No.: 600,615

[22] Filed: Apr. 16, 1984

[51] Int. Cl.[4] ..... B65D 90/00

[52] U.S. Cl. ..... 232/43.1; 220/1 T; 49/483

[58] Field of Search ..... 232/43.1; 414/292; 220/1 T, 2, 308; 49/483, 485, 488

[56] References Cited

U.S. PATENT DOCUMENTS

| | | | |
|---|---|---|---|
| 2,844,118 | 7/1958 | Kummerman | 49/485 X |
| 3,126,591 | 3/1964 | Hamilton | 220/378 X |
| 3,141,609 | 7/1964 | Roth | 232/43.1 |
| 3,696,561 | 10/1972 | Harp et al. | 220/378 X |
| 4,152,979 | 5/1979 | Schmidt | 220/1 TX |
| 4,290,352 | 9/1981 | Schmidt et al. | 220/1 TX |
| 4,306,398 | 12/1981 | Duckett | 49/483 X |

FOREIGN PATENT DOCUMENTS

| | | | |
|---|---|---|---|
| 3007508 | 9/1981 | Fed. Rep. of Germany | 220/1 T |

*Primary Examiner*—Robert P. Swiatek
*Attorney, Agent, or Firm*—Edward W. Osann, Jr.

[57] ABSTRACT

A waste material handling container for sludges and the like having a liquid tight seal between a container door and its associated opening. The seal comprises a heavily armored resilient element and a cooperating rigid element arranged to engage the unarmored portion of the resilient sealing element through a gap in its armor. The container includes a system for selectively adjusting pressure on the door to apply a substantially uniformly distributed pressure on the resilient sealing element. The latter is formed of natural rubber having good resistance to a wide range of aggressive chemical wastes.

6 Claims, 19 Drawing Figures

Fig. 17a.
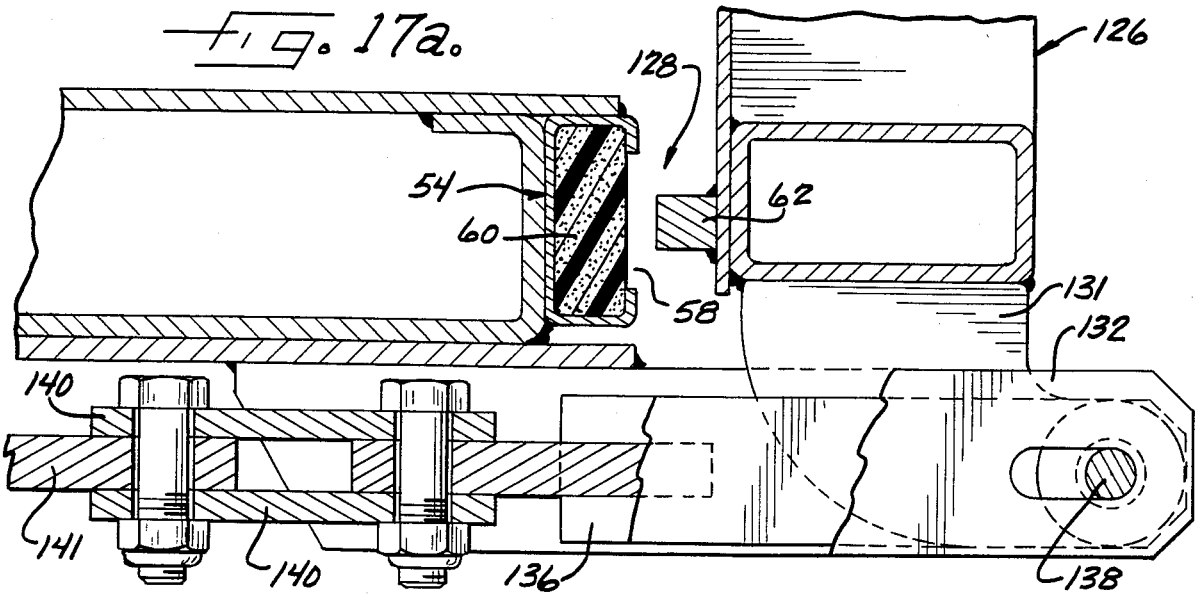
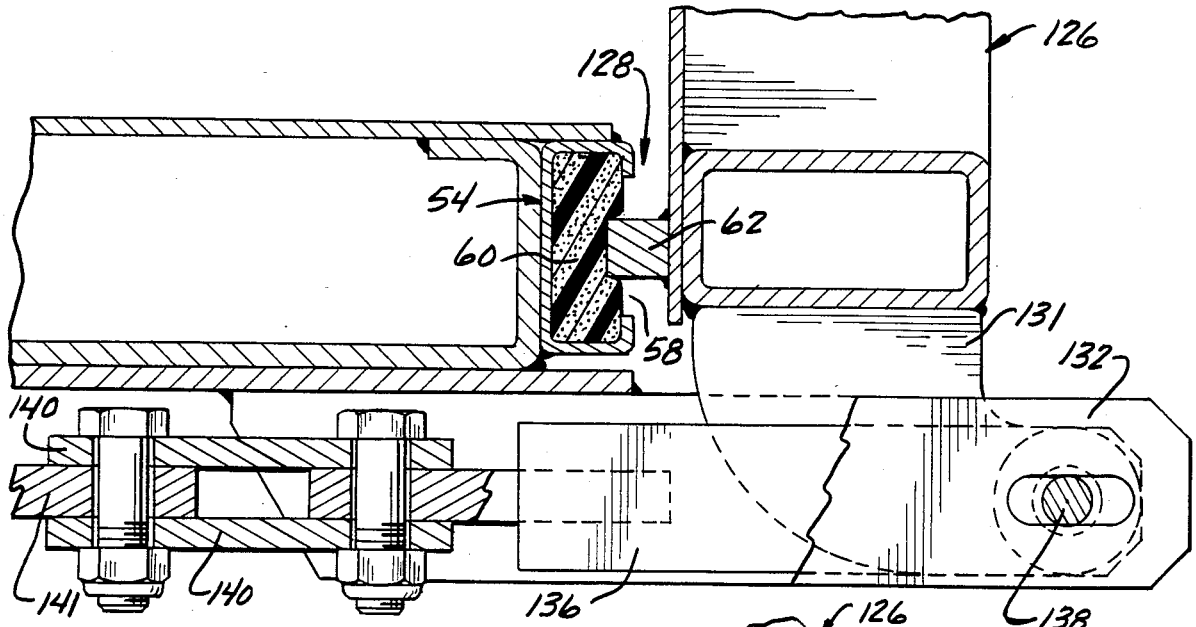
Fig. 17b.
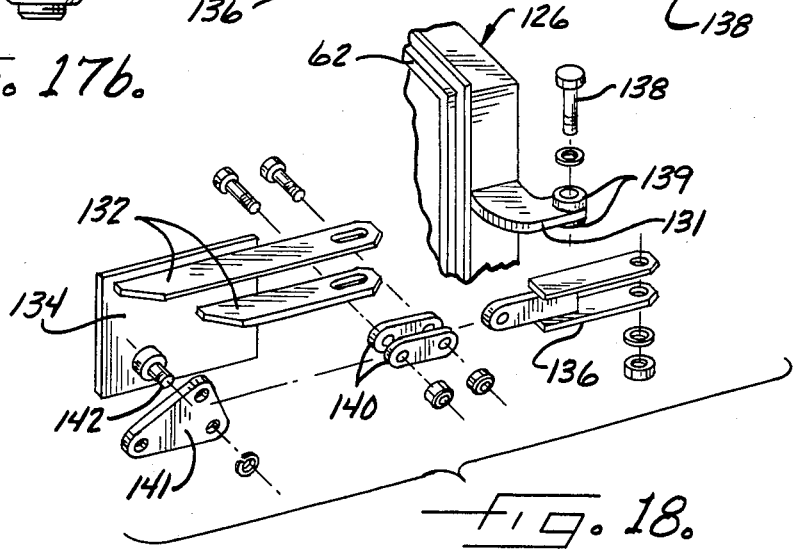
Fig. 18.

WASTE MATERIAL HANDLING CONTAINER WITH LIQUID TIGHT DOOR SEAL

BACKGROUND OF THE INVENTION

The present invention relates in general to the field of transportable waste container for liquid waste, or mixtures of liquid and solid waste such as various sludges. It finds particular, but not exclusive, utility in waste containers of the type adapted to be picked up and set off by a transport vehicle with an appropriate power unit known as a "roll-off hoist".

The problem of waste handling, waste transport and disposal is one that has become increasingly urgent in our highly industrialized society. Liquid and solid wastes of all kinds, both toxic and nontoxic, are generated by industrial plants, hospitals, laboratories, mining operations, and consumers. These materials are accummulated in extremely high volume and must be handled, transported and disposed of without undue risk to the public health and safety, or to the personnel who handle them during transport and disposal.

In normal usage, waste containers are subject to rough handling and are therefore ruggedly constructed. With day to day use, however, some damage or misalignment of closure members and their associated seals inevitably occurs. This can result in leakage of the container during stationary use or transport, with consequent risks, or costly down time while the container is being repaired.

SUMMARY OF THE INVENTION

One object of the present invention is to provide waste containers for sludges and the like having a liquid tight seal between a container door and its associated opening which will maintain its sealing integrity when subjected to a wide variety of aggressive chemical waste products during normal usage.

Another object of the invention is to provide a waste container for sludges and the like having a liquid tight door seal and including means to compensate for variations in alignment or damage to those components relied upon for maintaining the integrity of the seal.

A further object of the invention is to provide a waste container of the character set forth above having a liquid tight door seal adapted to remain effective during loading and transport of the container.

Still another object is to provide a waste container of the foregoing type having a dump door adapted to open easily and to clear the discharge area automatically as an incident to rearward tilting of the container during the dumping operation.

A further object of the invention is to provide a waste container of the above character having a liquid tight door seal adapted to perform its sealing function effectively over a long period of time.

The foregoing objects are accomplished in the present instance by constructing a waste container of the above type and interposing between a door closure and its associated opening a heavily armored resilient sealing element and a mating rigid element constructed and arranged to engage the unarmored portion of the resilient sealing element through a gap in its armor; including a system of selectively adjusting the pressure on the door to apply a substantially uniformly distributed sealing pressure on the sealing element; and forming the sealing element of material such as natural rubber having good resistance to a wide range of aggressive chemical wastes.

BRIEF DESCRIPTION OF THE DRAWINGS

FIGS. 17*a* and 17*b* are further enlarged, fragmentary horizontal sectional views taken in the plane of the line 17—17 in FIG. 15 and showing the sealing means in the disengaged and engaged portions, respectively.

FIG. 18 is an exploded perspective view detailing a hinge assembly of the side hinged dump door.

DETAILED DESCRIPTION OF THE INVENTION

Figure 1:
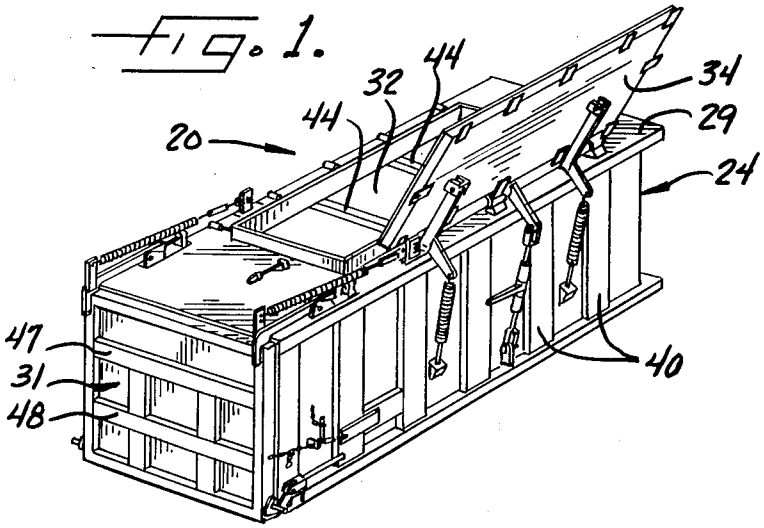
FIG. 1 is a perspective view of a waste material handling container of the roll-off type incorporating liquid tight seal means exemplifying the present invention.
Figure 2:
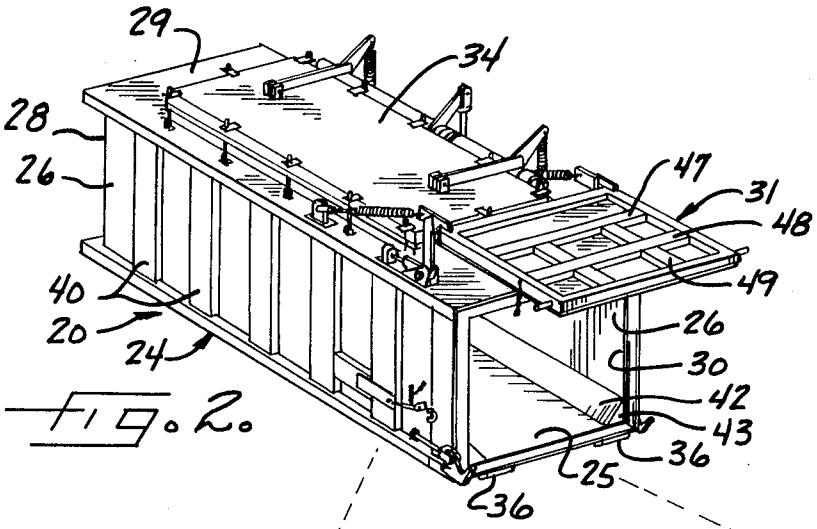
FIG. 2 is another perspective view of the waste container shown in FIG. 1 with the discharge or dump door in fully opened position and the loading or fill door in closed position.
Figure 3:
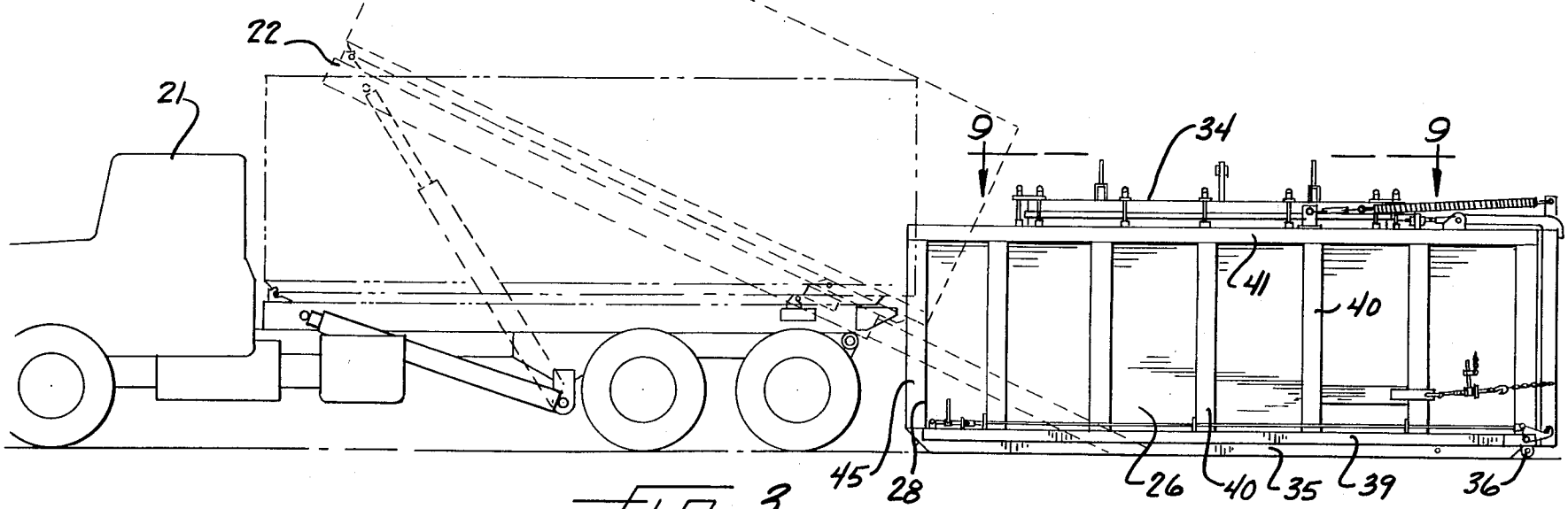
FIG. 3 is a side elevational view of the illustrative waste container of FIGS. 1 and 2, shown in association with a transport vehicle and a roll-off power hoist for picking up and dropping off the container.

Referring more specifically to FIGS. 1–3, the present invention is there exemplified in an illustrative material handling container 20 of the roll-off type. The container is adapted to be carried on a transport vehicle such as truck 21 and dropped off at a waste generating site by use of the roll-off power hoist on the vehicle. When loaded with waste material such as various chemical sludges, including both solid and liquid material, the container 20 is picked up by the power hoist of the truck 21 and transported to an appropriate waste disposal site where the container is emptied and readied for another load.

In normal usage, the container 20 is subjected to heavy loading, a harsh chemical environment, and rough handling. Accordingly, it is constructed of heavy gauge sheet metal, preferably steel plate, heavily reinforced by structural members to enhance its strength. The container comprises a generally rectilinear body 24 constructed as a unitary weldment. The body comprises a floor 25, a pair of opposed side walls 26, a front wall 28 and a roof 29. These members are joined together in liquid tight relation by welded seams. The body 24 has a discharge opening 30 and an associated dump door 31 situated at its rearward end and connected to the body by a hinge mechanism. The body also has a filling opening 32 and an associated fill door 34 located in the roof 29. The door 34 is connected to the body by a different hinge mechanism.

By reason of the high density of the waste material carried in the container 20, and the necessity of transferring the container to and from the transport vehicle by a roll-off hoist, the floor 25 is heavily reinforced (FIGS. 1–4, 11, 12). The entire container 25, including the floor, rests upon a pair of laterally spaced, longitudinal ground skids 35 having a pair of ground engaging rollers 36 adjacent their rearward ends. A plurality of longitudinally spaced transverse beams 38 are interposed between the skids 35 and the floor itself and held in place by appropriate structural welds. The ends of the transverse beams 38 are protected by a longitudinally extending rub rail 39 of channel cross section situated outboard of each side wall 26.

Figure 12:
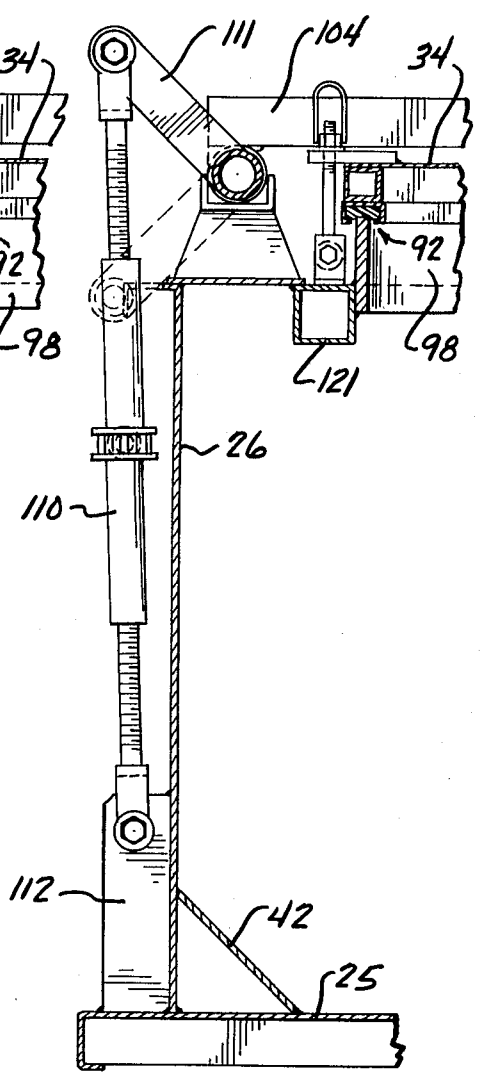
FIGS. 11 and 12 are fragmentary transverse vertical sectional views, taken respectively in the planes of the lines 11—11 and 12—12 in FIG. 10.
Figure 11:
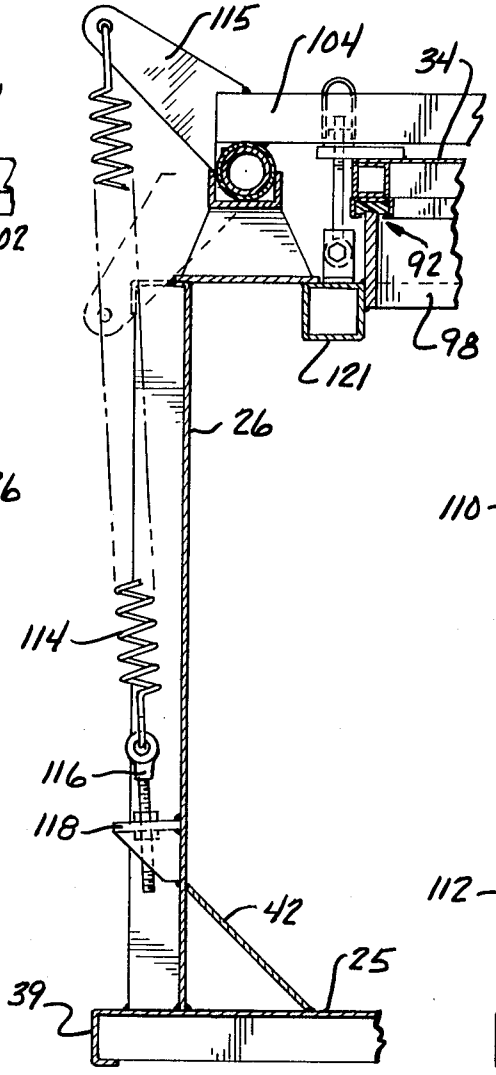
Figure 10:
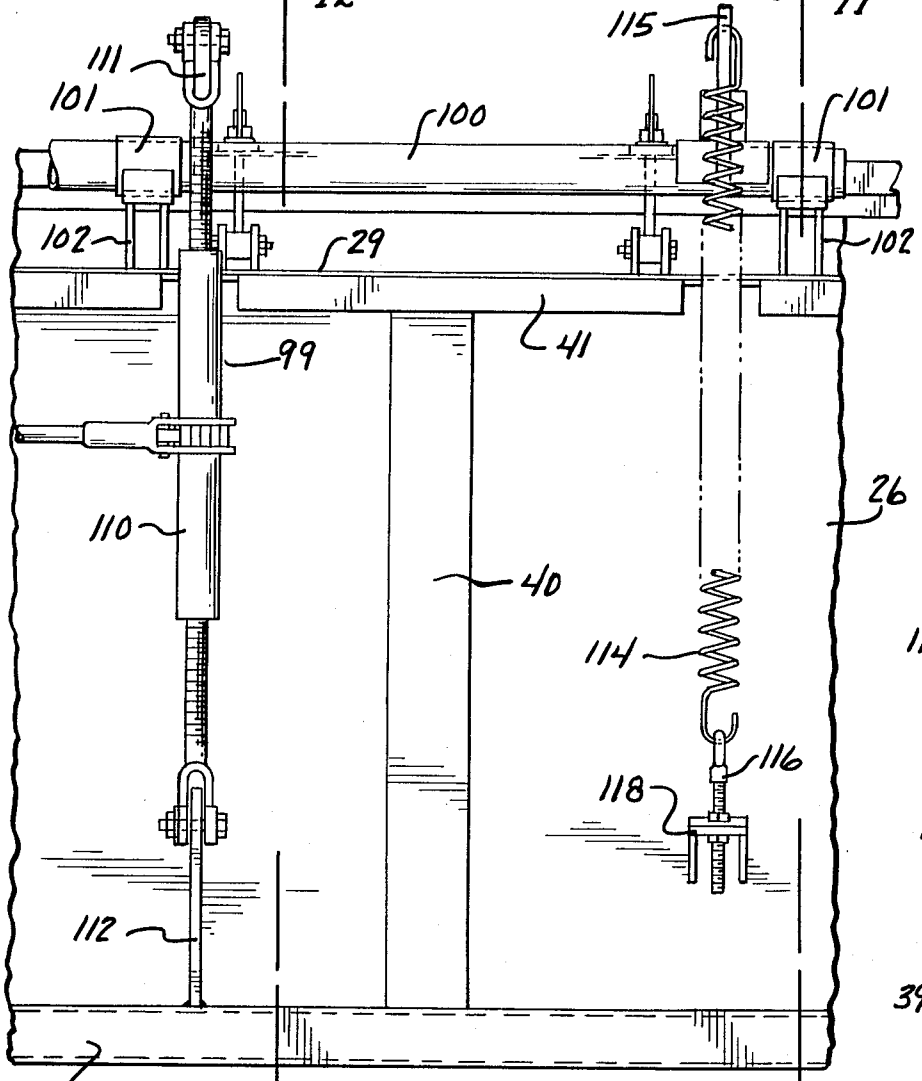
FIG. 10 is a fragmentary elevational view of the right hand side of the waste container, taken in the plane of the line 10—10 in FIG. 9.
Figure 13:
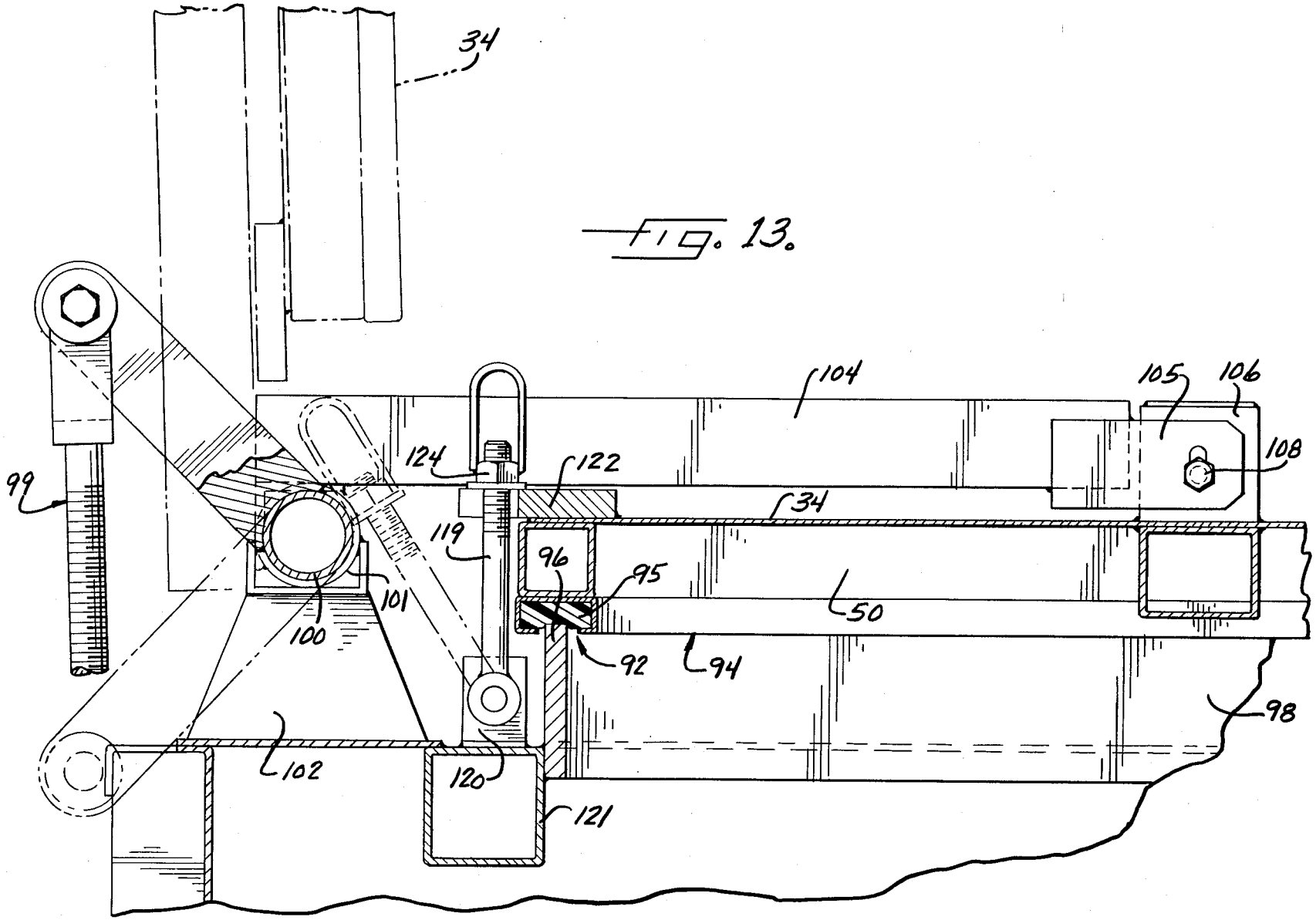
FIG. 13 is a further enlarged, fragmentary vertical sectional view showing details of the fill door and its hinge and sealing means, taken in the plane of the line 13—13 in FIG. 9.

Each of the side walls 26 is reinforced by a plurality of side wall struts 40 of channel cross section welded thereto between the rub rail 39 and an overhanging channel 41 defining the outer edge of the roof. The junction between each of the side walls and the container floor 25 on the inside of the container is reinforced by longitudinally extending gusset plate 42 and end gusset plates 43 (FIGS. 2, 11, 12). The side walls are further reinforced adjacent their upper edges in the region of the filling opening 32 by means of cross struts 44 (FIG. 1).

The front wall of the container 20 is reinforced on the outside by means of a pair of upstanding tubular struts 45 fixed at their lower ends to the nose cones of the ground skids 35 and at their upper ends to a transversely extending overhanging channel 41 of the roof. Additional reinforcement is also provided by means of the hitch connection for engagement by the cable of the roll-off hoist.

The dump door 31, as indicated earlier herein, serves as the closure for the discharge opening 30 of the container (FIGS. 1, 2, 4–7). The door 31 comprises a relatively heavy rectangular metal panel reinforced along its outer marginal edge portion with a frame 46 of high strength structural tubing welded thereto. The area of the door 31 within the frame 46 is further reinforced by a plurality of horizontal channel beams 47, 48 mounted with their flanges abutting the door panel and secured in place with continuous welds. Vertical channel struts 49 are interposed and welded between the upper and lower channel beams 47, 48, and between the beam 48 and the lower section of the frame 46.

The fill door 34 comprises a generally rectangular metal panel reinforced along the marginal edge portion of its inner or lower face by a peripheral frame 50 of high strength tubing (FIGS. 1–3, 9, 11, 12). The door panel is also strengthened by a plurality of transverse tubular struts 51, in the present instance three in number, running between the longitudinal sections of the frame 50. Further stiffening may be provided by a grid of intermediate structural members (not shown) fixed to the door panel between the struts 51 and the sections of the peripheral frame 50.

In accordance with the present invention, a liquid tight seal 52 is interposed between the container body 24 and the dump door 31 comprising a heavily armored resilient element and a coacting rigid element adapted to engage the resident element through a gap in its armor. These coacting elements are disposed in surrounding relation with the discharge opening 30.

Referring more specifically to FIGS. 4–8, it will be noted that the foregoing is accomplished in part by providing an armor frame 54 secured in this instance to the side walls 26, floor 75 and roof 29 by continuous liquid tight welds and to the outer edges of the adjacent side beams by skip welds. The frame 54 is formed from a channel 55 with the free edge portions thereof defining in-turned flanges 56 extending toward one another so as to leave a relatively small gap 58 between them. The flanges 56 are substantially parallel to the back wall of the channel 55.

Figure 6:
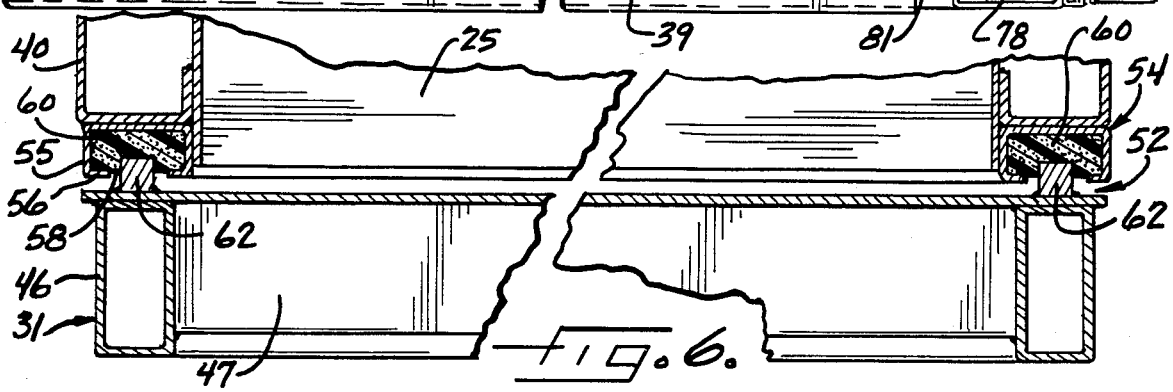
FIG. 6 is a broken horizontal sectional view through the dump door and sealing means, taken in the plane of the line 6—6 in FIG. 4.
Figure 7:
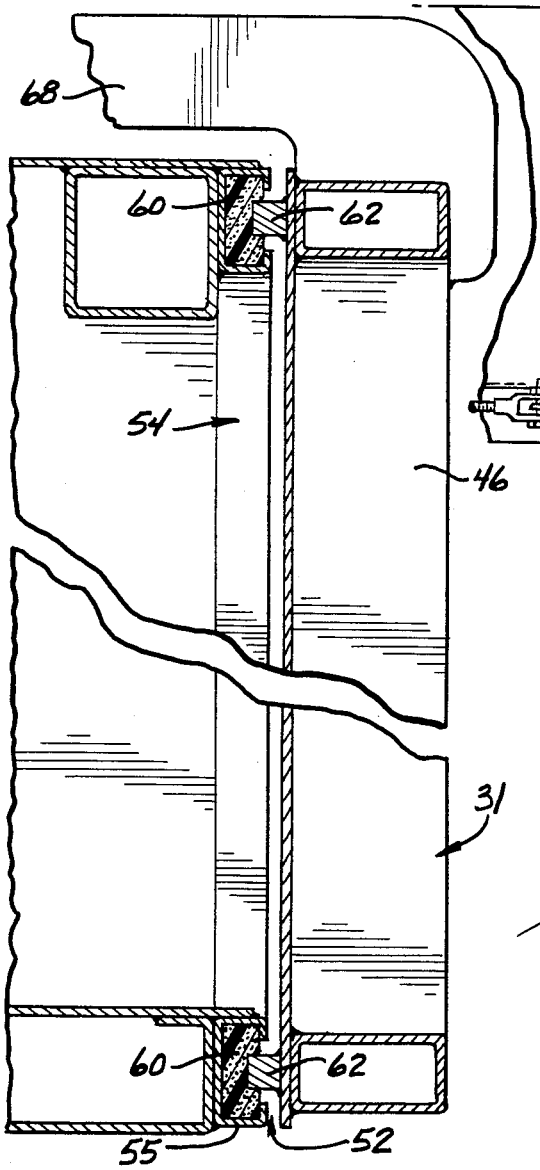
FIG. 7 is an enlarged broken vertical sectional view through the dump door and sealing means, taken in the plane of the line 7—7 in FIG. 5.
Figure 8:
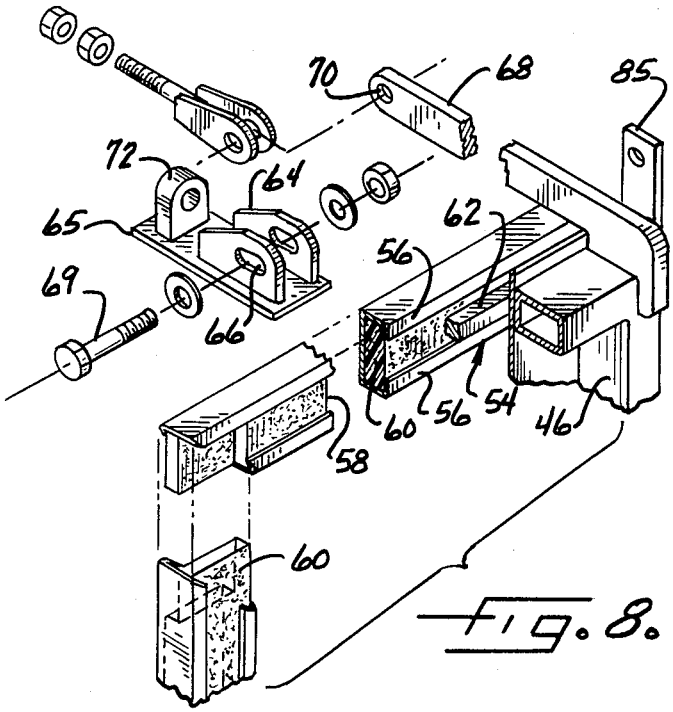
FIG. 8 is an exploded perspective view illustrating the relation of the various sealing elements and a portion of the hinge means for the dump door.
Figure 9:
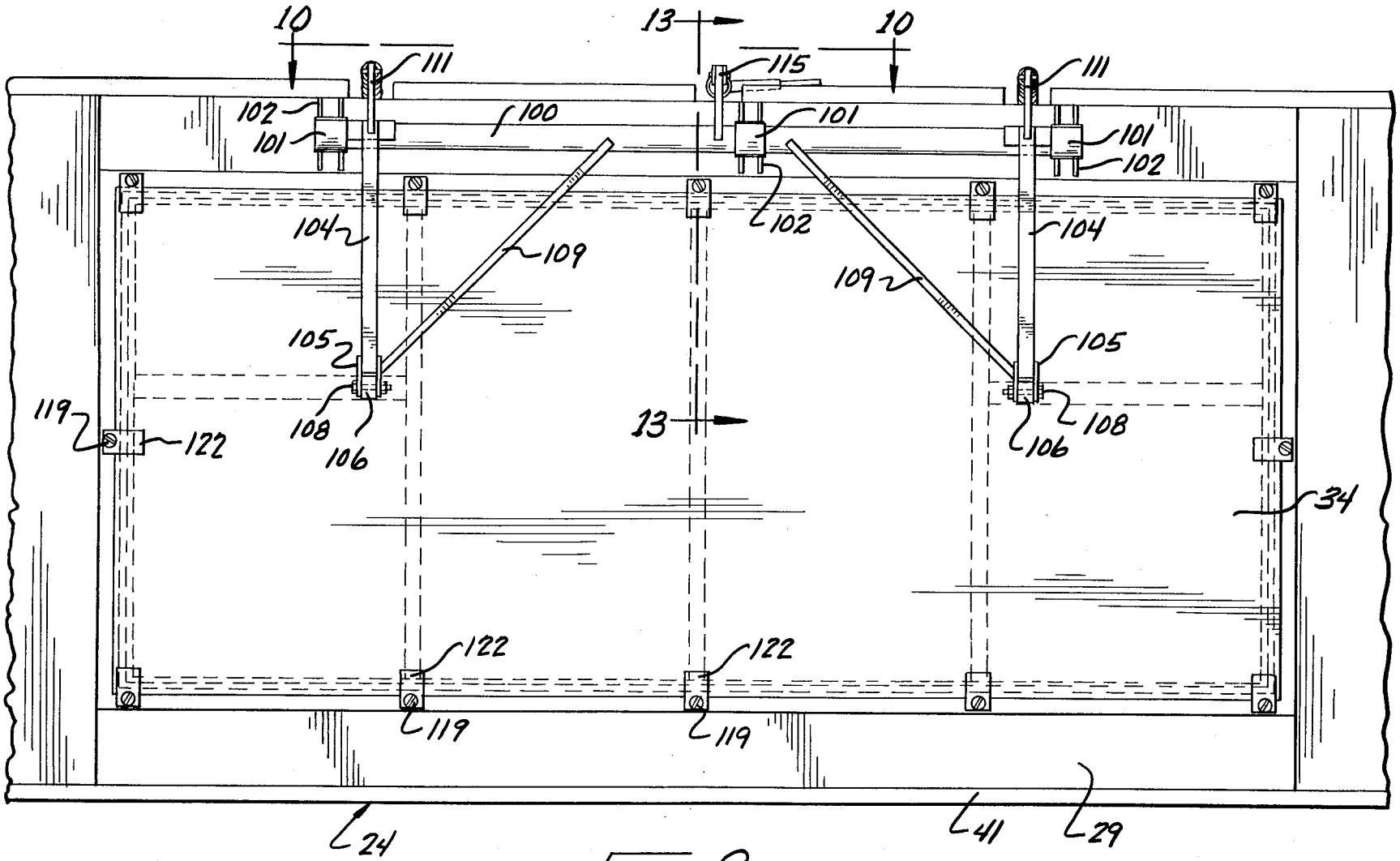
FIG. 9 is an enlarged fragmentary plan view of the container showing the fill door in closed position.

A resilient gasket 60 of generally rectangular cross section is housed within the armor frame 54 and secured in place by the in-turned flanges 56 (FIGS. 4, 6–8). To preclude the possibility of leakage at the corners of the frame 54, the corner end portions of the gasket are partially cut away and the remaining portions 61 overlapped so as to maintain constant gasket thickness (FIG. 8).

To complete the liquid tight seal 52, a rigid sealing rib 62 is fixed to the inside face of the dump door 31 in a configuration adapted to register with the gap 58 in the armor of the gasket 60 (FIGS. 6–8). The sealing rib 62 has a generally square or rectangular cross section with lightly rounded corners. The rib 62 is attached to the inner door face by a continuous weld along the inner perimeter of the rib and by a skip weld along its outer perimeter. When the door closes, the sealing rib 62 presses against the exposed surface of the gasket 60 to initiate the sealing action.

The dump door 31 in this instance is pivotably supported by a pair of top hinges 64 fixed to the marginal edge portions of the container roof 29 a few inches forward of the discharge opening 30 (FIGS. 1–5, 8). Each hinge 64 comprises a pair of spaced apart, parallel padeyes 65 having aligned apertures 66 of oblong shape. Each pair of padeyes 65 straddles the end portion of a corresponding pivot arm 68 fixed to a top corner of the door frame 46. A through bolt 69 passing through the padeye apertures 66 and a hole 70 in the pivot arm 68 secures the latter in the hinge. The location of the pivot axis in each hinge 64 may be adjusted by means of a stop stud 71 threadedly engaged in another padeye 72 spaced from the padeyes 65. This adjustment permits the door 31 to be positioned so that the sealing rib 62 will engage gasket 60 with substantial uniformity throughout its length.

Figure 4:
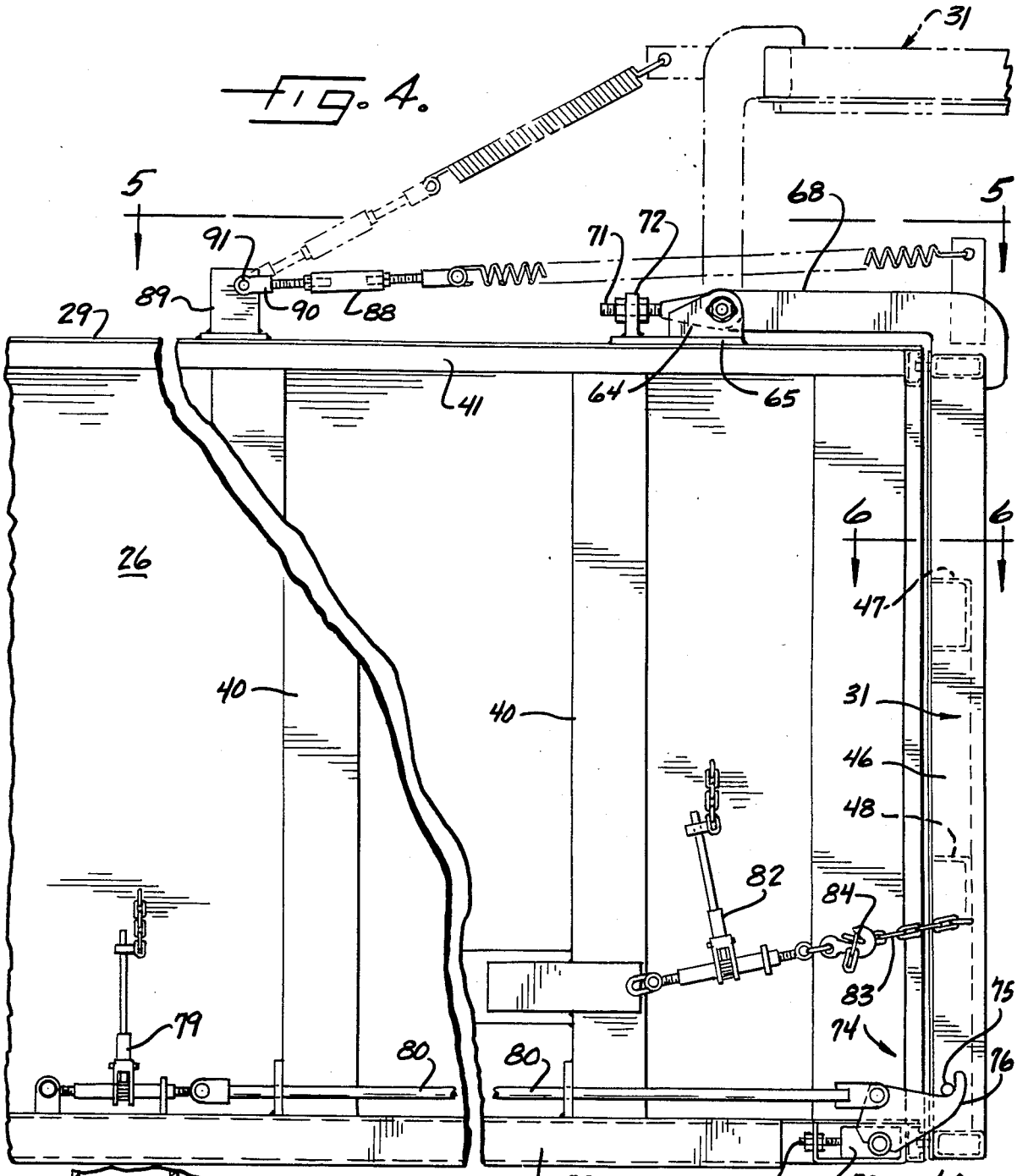
FIG. 4 is an enlarged, fragmentary, side elevational view showing the rearward portion of the waste container with the dump door secured in fully closed, liquid tight condition.

Provision is made in the container 20 for assuring adequate pressure on the dump door 31 to seal in the load under the severest operating conditions (FIGS. 1–5). This is accomplished by augmenting the sealing pressure between the rib 62 and the gasket 60 in several respects. Accordingly, a pair of tensioned latches 74 is situated adjacent the bottom of the door frame 46. These latches engage a mating pair of securing pins 75 projecting outwardly from the lower portion of the dump door. Each latch comprises a draw hook 76 pivotally mounted on a base 78 and tensioned by means of a ratchet binder 79 and tie rod 80 pivotally attached to the draw hook 76. Latch pressure may be regulated by means of adjusting stud 81 (FIG. 4).

In addition to the latches, a pair of ratchet binders 82 with a capacity of 10,000 pounds, for example, is attached to the sides of the container and each is detachably connected as by hook 84 to a short length of chain 85 secured to the side of the door frame 46. The chain 85 is attached to the door near the end of the lower horizontal reinforcing beam 48 and the associated ratchet binder 82 is attached to a side wall strut 40 at a slightly lower point to provide a small downward component in the tensile force of the ratchet binder 82. The combined effect of the ratchet binders 82 and the tensioned latches 74 results in sufficient pressure between the sealing rib 62 and the gasket 60 to maintain the liquid tight integrity of the seal 52 with the container 20 under fully loaded conditions.

As indicated earlier herein, the liquid tight seal 52 and its components are subjected to severe operating conditions during normal usage of the container 20. These include both aggressive chemical environment and rough treatment of the container. The gasket 60 must remain stable and resilient throughout the full range of these adverse conditions. One material which has been found eminently satisfactory for the gasket 60 is a natural open cell sponge rubber layer approximately one inch thick, covered on its opposed faces with a tough natural rubber skin. This gasket material carries the stock number "OCG13" or "R-13" and possesses the following physical and thermal properties:

| Property | Parameter |
|---|---|
| Color | Black |
| ASTM-67 | RO-14 |
| D1056-78 | RO-14 |
| Compression Deflection psi 25% Deflection | 13–17 |
| Density, p.c.f. | 35 |
| Lineal Shrinkage (Max.) % 7 Days at 158° F. | 1% |
| Temperature Range | |
| Low: | −40° F. |
| High: | 150° F. |
| Tensile Strength (Min.) psi | 200 |
| Elongation (Min.) % | 250 |
| pH Range Limits | 3–12 |
| Ozone/Weather Resistance | Good |
| Durometer "00" (±10) | 65 |

Figure 5:
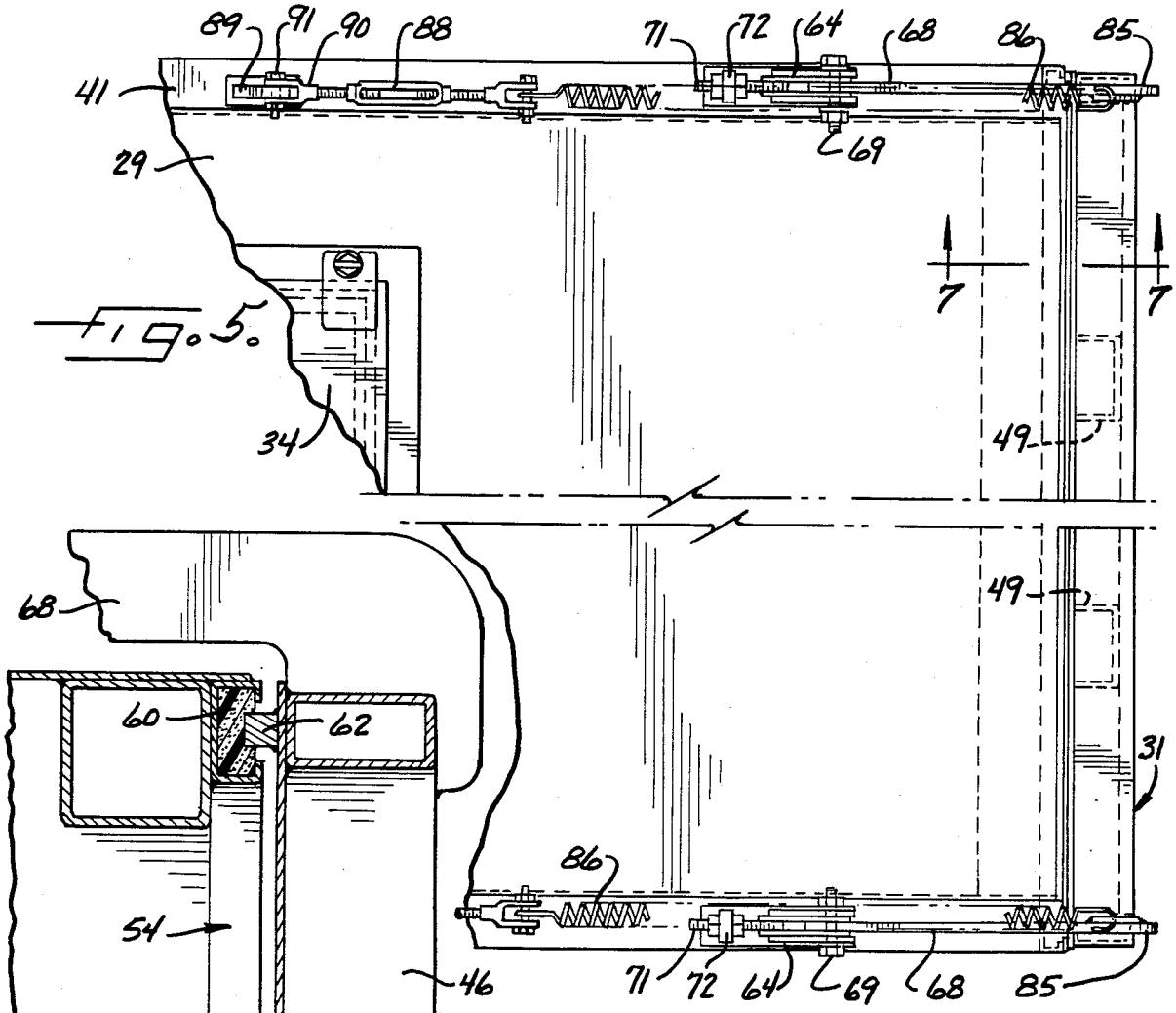
FIG. 5 is an enlarged, fragmentary plan view showing the rearward portion of the waste container with the dump door in the condition illustrated in FIG. 4.

Provision is made for swinging the dump door 31 out of the way as an incident to tilting the container 20 rearwardly for a dumping operation. To accomplish this, the pivot arms 68 are extended forwardly of the plane of the door 31 in laterally spaced relation, as shown in FIGS. 4 and 5, to the point of connection with the hinges 64. In addition, an upstanding bracket 85 disposed in parallel relation to the plane of the door 31 is welded or otherwise fixed to the rearward end of each pivot arm 68 near its point of attachment to the door. A relatively strong tensile spring 86 is connected at one end to each bracket 85 and at its opposite end to an adjusting turnbuckle 88 pivotally attached to an upstanding anchor flange 89 fixed to the container roof. The turnbuckle 88 is pivotally attached to the anchor flange 89 by means of a clevis 90 and pivot pin 91.

With the container 20 loaded and situated on the power hoist 22 of truck 21, the dumping operation is initiated by raising the forward end of the container as indicated in broken lines in FIG. 3. At that point, the ratchet binders 82 are released and their hooks 82 released from the door chains 83. The door frame latches 74 are also disengaged by loosening the ratchet binders 79 and the draw hooks 76 of both latches. When this occurs, the center of gravity of the door 31 and the rearward pressure of the load causes the door to swing counter clockwise as viewed in FIG. 4. The tensile force in the springs 86 thereupon swings the door 31 in an arcuate path about the forwardly offset hinge points. At the conclusion of the dumping operation, the door may be reclosed by pulling it down manually and engaging the draw hooks 76 of the latches.

Turning next to the filling opening 32 and its associated fill door 34, it will be noted that a liquid tight seal 92, similar to the seal 52, is interposed between the opening 32 and the fill door 34. In this instance, however, the armored gasket and sealing rib are reversed as compared with the seal 52 for the dump door. Armor frame 94 of channel cross section which houses resilient gasket 95 is secured as by means of continuous welds to the underside peripheral frame 50 of the fill door. Sealing rib 96 which is adapted to register with the gasket 95 through the gap in its armor is defined by the upstanding edge portion of coaming 98 surrounding the filling opening. The coaming is secured to the roof as by means of continuous welds.

The fill door 34 is adapted to be opened and closed by means of a hinge actuating mechanism 99 (FIGS. 9–13). The mechanism 99 in this case comprises a hollow pivot shaft 100 journaled in three sleeve bearings 101 spaced along the filling opening and fixed to mounts 102 on the container roof. A pair of hinge arms 104, each rigidly fixed at one end to the pivot shaft, has a clevis 105 at its opposite end. The clevis is adjustably connected to an upstanding padeye 106 on the fill door as by means of bolt 108. To impart additional rigidity to the hinge mechanism, an angular reinforcing bar 109 is secured between each clevis 105 and the pivot shaft 100.

For opening and closing the fill door, a ratchet type turnbuckle 110 is pivotally connected between a crank arm 111 fixed to pivot shaft 100 and an anchor bracket 112 fixed to the lower part of the container side wall. The crank arm extends outwardly at approximately a 45° angle to the horizontal and is adapted to swing with the fill door between the closed position where the door is horizontal and the open position where the door is vertical. In order to ease the load on the turnbuckle 110, a pair of tensile biasing springs 114 is provided. Each spring 114 is connected between a crank arm 115 similar to the arm 111 and an adjustable eyebolt 116 which is mounted in a bracket 118 fixed to the container side wall.

For the purpose of sealing the fill door 34 after closure, a series of hold down bolts 119 is mounted at spaced intervals around the coaming 98. Each bolt is pivotally attached to a bracket 120 fixed to the tubular reinforcing frame 121 connecting the coaming with the container roof 29. The outer face of the fill door 34 has a plurality of forked lugs 122 fastened around its edges and spaced at intervals corresponding to the spacing of the hold down bolts. With the foregoing construction, the liquid tight seal 92 can be subjected to sealing pressure by swinging the hold down bolts into engagement with the forked lugs and tightening the clamp nuts 124 in any suitable manner. While it is desirable to tighten the hold down bolts with reasonable uniformity, the adjustment is not as critical as in the case of the dump door 31 because the pressure against the fill door from the container load is much less than the pressure against the dump door.

Referring next to FIGS. 14–18, a modified form of waste material handling container 125 is there shown. The container 125 is substantially identical to the container 20 described earlier herein except for the fact that the dump door 126 of container 125 is of the side hinged type. With the exception of the hinges, the door guides 123, 127, and check chain 133 to hold the dump door 126 open for dumping, the door 126 is substantially identical to the dump door 31 and the liquid tight dump door seal 128 is substantially identical to the seal 52. The armor frame 54 of channel cross section is thus fixed to the container 125 in liquid tight relation around the discharge opening of the container. Sealing rib 62 is fixed to the inner face of the dump door 126 by continuous weld and adapted to register with the resilient gasket 60 through gap 58 in its armor. To apply sealing pressure upon the gasket 60 for all load conditions, the door 126 is equipped with adjustable hinges 129 and adjustable latches 130.

The adjustable hinges 129 in this instance happen to be three in number spaced adjacent the top, bottom and center of the side member of the dump door frame (FIGS. 14, 15, 17*a*, 17*b*, 18). Each hinge comprises a generally L-shaped hinge pivot arm 131 fixed to the side member of the door frame; a pair of hinge support arms 132 extending in cantilever fashion from a mounting plate 134 fixed to the container side wall; and a hinge adjusting linkage 135.

Each linkage 135 includes a clevis 136 pivotally connected at one end to hinge pivot arm 131 by hinge bolt 138 and spacers 139 (FIG. 18). The clevis is slidably guided within the hinge supporting arms which have oblong clearance openings 137 for the hinge bolt. The opposite end of the clevis 136 is pivotally connected by links 140 to bell crank 141. The bell crank is pivotally attached to fixed pin 142 on mounting plate 134. The bell crank is also pivotally coupled to adjusting bar 144 which has an L-shaped cross section. The bar 144 is pivotally coupled to the bell cranks of the other two hinges. A ratchet binder 145 is connected between a bracket 146 fixed to the container base and a bracket 148 fixed to the adjusting bar 144. Operation of the ratchet binder will raise or lower the bar 144 and thus adjusts all three hinges in unison to vary the sealing pressure on the resilient gasket 60.

Figure 14:
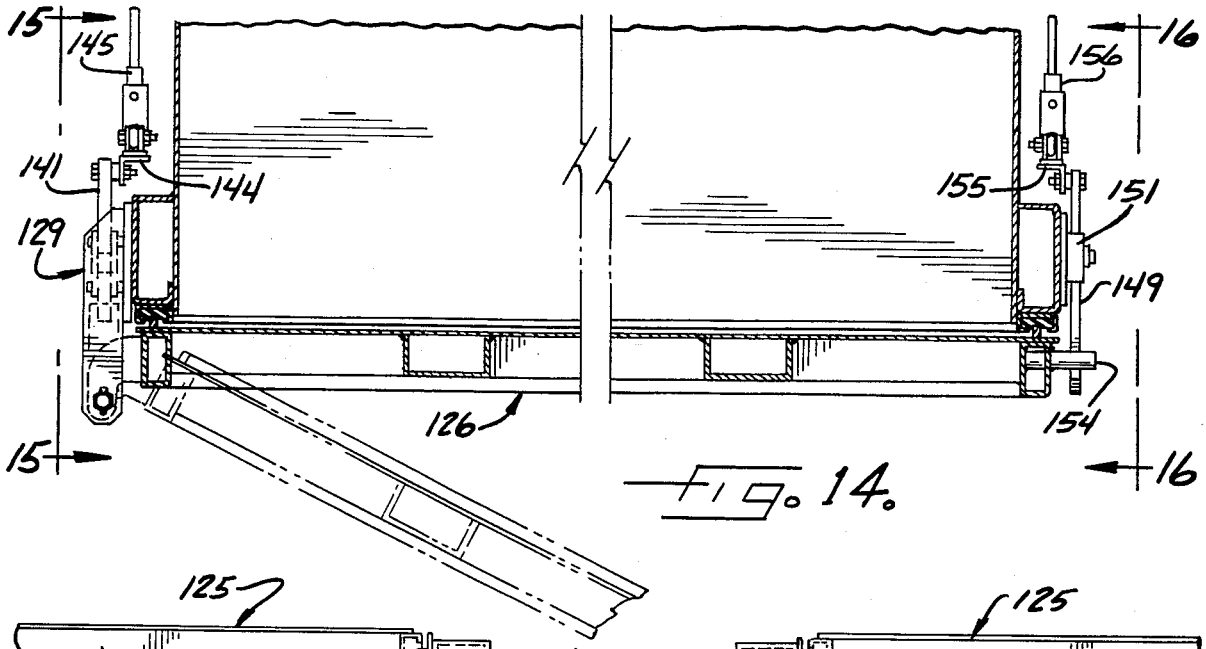
FIG. 14 is an enlarged, fragmentary horizontal sectional view taken through a waste container similar to that of FIGS. 1–13 but having a side hinged dump door.
Figure 15:
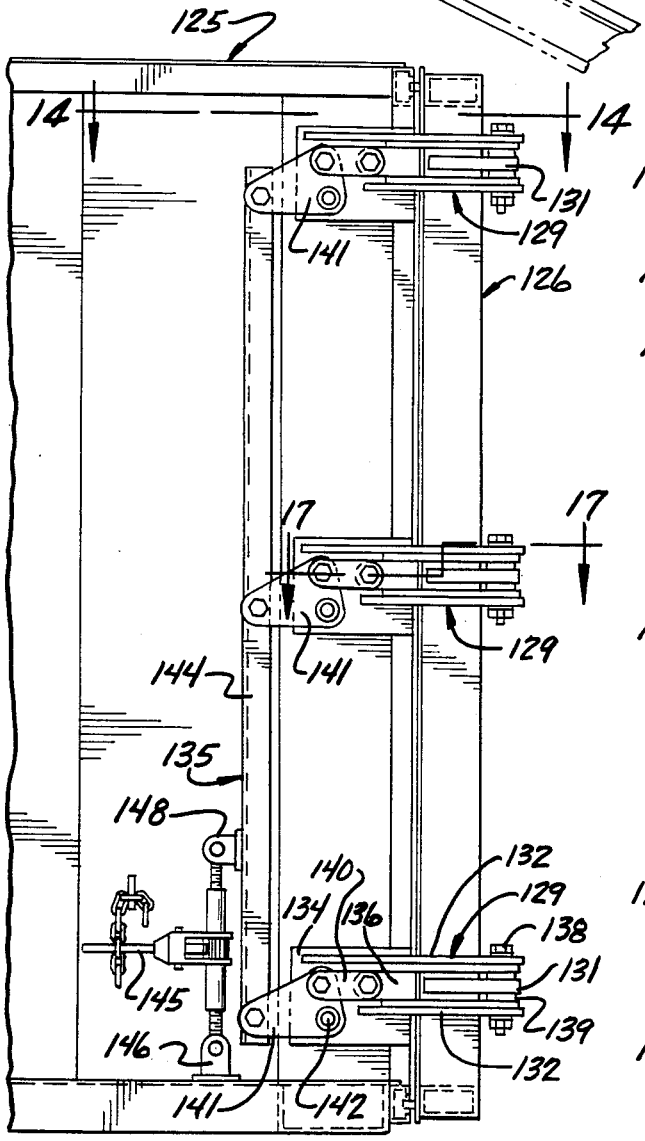
FIGS. 15 and 16 are enlarged, fragmentary elevational views illustrating each side of the dump door taken in the planes of the lines 15—15 and 16—16, respectively, in FIG. 14.
Figure 16:
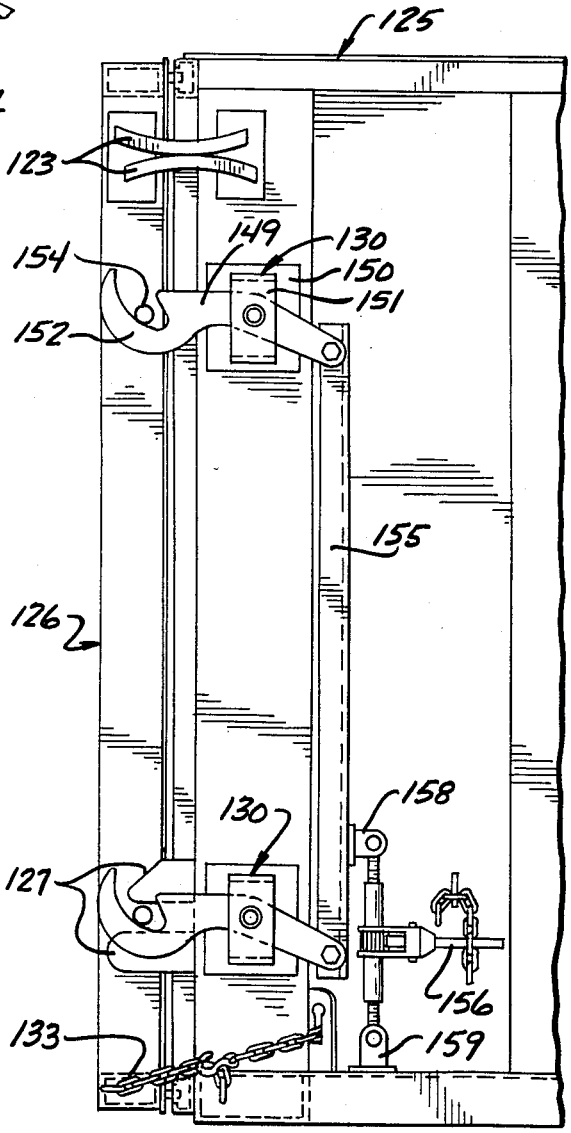

The adjustable latches 130 for the dump door 126 are two in number and situated respectively toward the upper and lower regions of the door (FIGS. 14, 16). Each latch 130 comprises a draw hook 149 pivotally attached to a mounting plate 150 and confined thereon by guide plate 151. The draw hook is formed at one end with an inclined finger portion 152 adapted to engage an outwardly projecting pin 154 on the adjacent side member of the door frame. The opposite end of the hook is pivotally connected to an operating bar 155 of L-shaped cross section. The bar 155 is similarly connected to the hook of the other latch. A ratchet binder 156 connected between bracket 158 on operating bar 155 and a bracket 159 fixed to the container base operates both latches in unison. Operation of the ratchet binder to raise the bar 155 serves to decrease the hook pressure on the door and ultimately releases it. Operation of the ratchet binder to lower the bar 155 serves to engage the draw hooks with the latch pins 154 and increases the hook pressure on the door. This increases the sealing pressure on the resilient gasket 60.

It will be appreciated from the foregoing that coordinating the adjustment of the hinges 129 and the adjustment of the latches 130 will achieve sufficient uniformly distributed pressure on the resilient gasket 60 to withstand the maximum loading on the container 125.

I claim:

1. A liquid tight waste material handling container for sludges and other waste products, said container adapted to be transported to a waste generating site for loading and subsequently transported to a disposal site for unloading, and comprising, in combination:

(a) a body comprising a floor, a pair of opposed side walls, a front wall, and a roof;

(b) means for loading said body with waste material including liquid content;

(c) means defining a discharge opening at the end of said body remote from said front wall;

(d) an armored sealing frame member closed on all sides except for a longitudinal gap in one side thereof;

(e) a resilient sealing element enclosed within said armored sealing frame member except for said gap;

(f) a dump door hingedly attached to said body as a closure for said discharge opening, said dump door being attached to said body by side hinges and held closed by latches;

(g) a rigid continuous sealing rib fixed in liquid tight relation to the inside face of said dump door and adapted to register with said armored resilient sealing element through said armor gap upon closure of said door;

(h) and means for pressing said dump door and its sealing rib against said resilient sealing element to define a continuous liquid tight seal around said discharge opening;

(i) said pressing means for said dump door including first tensile adjustment means connected to said hinges and second tensile adjustment means connected to said latches for maintaining uniform sealing pressure on said sealing element.

2. A waste material handling container as defined in claim 1, wherein said container has a second door opening and a door adapted to close said opening, and a second sealing frame member, a second resilient sealing element, and a second sealing rib member interposed between said second door opening and said second door.

3. A transportable waste container adapted to hold liquid waste or a mixture of liquid and solid waste, comprising in combination;

(a) a container body of generally rectilinear shape having a discharge opening at one end;

(b) a sealing frame surrounding said discharge opening and having a cross section in the form of a channel closed on three sides and partially closed on the fourth side;

(c) a resilient sealing gasket disposed in said sealing frame channel;

(d) a door hinged to said container body and adapted to close said discharge opening;

(e) said door having a solid face with an area slightly overlapping said discharge opening;

(f) a sealing rib fixed to the face of said door in liquid tight relation therewith and adapted to engage said resilient sealing gasket in said channel;

(g) means for drawing said door against said sealing frame so that said sealing rib deflects said sealing gasket to define a continuous liquid tight seal surrounding said discharge opening; and (h) said means for drawing said door against said sealing frame including a pair of adjustably tensioned latches adjacent the bottom of said door and a pair of adjustably tensioned ratchet binders connected to an intermediate region on the sides of said door.

4. A transportable waste container as defined in claim 3, which further comprises:

(a) a pair of hinge pivot arms fixed in laterally spaced relation to the top edge portion of said door and extending normal to the plane of said door toward the forward end of said container;

(b) means pivotally and adjustably securing the forward ends of said hinge pivot arms to the top of said container;

(c) a pair of upstanding brackets disposed in parallel relation to the plane of said door and each fixed respectively to the rearward end portion of one of said hinge pivot arms adjacent its point of attachment to said door;

(d) a pair of tensile springs each connected between a respective upstanding bracket and a respective anchorage on said container top spaced forwardly of said pivotal and adjustable securing means;

(e) said door being adapted to swing upward automatically to clear said discharge opening upon rearward tilting of said container for dumping.

5. A liquid tight waste material handling container for sludges and other waste products, said container adapted to be transported to a waste generating site for loading and subsequently transported to a disposal site for unloading, comprising, in combination:

(a) a body comprising a floor, a pair of opposed side walls, a front wall, and a roof;

(b) means for loading said body with waste material including liquid content;

(c) means defining a discharge opening at the end of said body remote from said front wall;

(d) an armored sealing frame member closed on all sides except for a longitudinal gap in one side thereof;

(e) a resilient sealing element enclosed within said armored sealing frame member except for said gap;

(f) a dump door hingedly attached to said body as a closure for said discharge opening, said dump door being attached to said body by side hinges and held closed by latches;

(g) a rigid continuous sealing rib fixed in liquid tight relation to the inside face of said dump door and adapted to register with said resilient sealing element through said armor gap upon closure of said door;

(h) means for pressing said dump door and its sealing rib against said resilient sealing element to define a continuous liquid tight seal around said discharge opening;

(i) said pressing means for said dump door including tensile adjustment means connected to said hinges and to said latches, said hinges being adapted to be adjusted in unison and said latches also being adapted to be adjusted in unison, whereby uniform sealing pressure may be maintained on said sealing element.

6. A waste material container as defined in claim 5, wherein said resilient sealing element is formed of natural open cell sponge rubber with a tough rubber skin and has at least the following physical and thermal properties:

| Property | Parameter |
|---|---|
| Compression Deflection psi 25% Deflection | 13–17 |
| Temperature Range | |
| Low | −40° F. |
| High | 150° F. |
| Tensile Strength min. psi | 200 |
| pH Range Limits | 3–12 |
| Durometer "00" (±10) | 65. |

* * * * *